United States Patent [19]

Ewert

[11] Patent Number: 4,928,333

[45] Date of Patent: May 29, 1990

[54] COLLAPSIBLE ARTICLE OF FURNITURE

[75] Inventor: Werner H. Ewert, Johannesburg, South Africa

[73] Assignee: Hans Bonatz, Rosenweg, Fed. Rep. of Germany

[21] Appl. No.: 398,295

[22] Filed: Aug. 24, 1989

Related U.S. Application Data

[63] Continuation of Ser. No. 109,950, Oct. 19, 1987, abandoned.

[30] Foreign Application Priority Data

Oct. 23, 1986 [ZA] South Africa ..... 86/8073

[51] Int. Cl.[5] ..... A47C 19/12

[52] U.S. Cl. ..... 5/110; 5/114

[58] Field of Search ..... 5/110, 112, 114, 116, 5/117, 131; 403/206, 207, 209, 210, 213

[56] References Cited

U.S. PATENT DOCUMENTS

| | | | |
|---|---|---|---|
| 169,138 | 10/1875 | Borgfeldt | 5/110 |
| 2,156,507 | 5/1939 | Means | 5/110 |
| 2,591,551 | 4/1952 | Kaplan | 5/110 |
| 3,097,368 | 7/1963 | Collins | 5/110 |
| 3,742,532 | 7/1973 | Bernstien | 5/110 |
| 3,956,781 | 5/1976 | Reemelin | 5/110 |

FOREIGN PATENT DOCUMENTS

| | | | |
|---|---|---|---|
| 1016872 | 11/1952 | France | 5/110 |
| 2063526 | 7/1971 | France . | |
| 2321255 | 3/1977 | France . | |
| 699444 | 11/1953 | United Kingdom | 5/110 |
| 83/01371 | 4/1983 | World Int. Prop. O. | 5/110 |

*Primary Examiner*—Gary L. Smith
*Assistant Examiner*—Eric K. Nicholson
*Attorney, Agent, or Firm*—Lackenbach Siegel Marzullo & Aronson

[57] ABSTRACT

A collapsible bed has a head frame and a foot frame that are of shaped metal tube. At each end of each frame there is a "U"-shaped recess. Two bars extend between the frames. At each end of each bar there is a disc with a peripheral channel. The discs seat in the recesses and lock therein. A sheet of material extends between the bars, the bars passing through casings on opposed sides of the sheet. The inner sides of the recesses of each frame slope towards one another to assist in guiding the discs into the recesses and to stretch the sheet of material.

7 Claims, 1 Drawing Sheet

COLLAPSIBLE ARTICLE OF FURNITURE

This application is a continuation of application Ser. No. 109,950, filed, 10-19-87, now abandoned.

FIELD OF THE INVENTION

This invention relates to an article of furniture that is collapsible and to a kit therefor. More particularly, the invention relates to a collapsible bed.

SUMMARY OF THE INVENTION

According to the invention there is provided a collapsible article of furniture which includes at least two support members which are spaced apart, each support member defining a pair of support surface regions that are substantially horizontally oriented and spaced apart and a pair of guiding and stretching surface regions, one for each support surface region with the guiding and stretching surface region of each support region extending upwardly from its associated support surface region;

a pair of elongate elements, one element extending between and being supported on one support surface region of one of the support members and a corresponding support surface region of the other support member and the other element extending between and being supported on the other two support surface regions; and a flexible web secured to the elongate elements and extending therebetween.

The article of furniture may be provided in kit form.

Thus, the invention extends to a kit for a collapsible article of furniture, which includes at least two support members each support member defining a pair of support surface regions that are spaced apart and which are, in use, oriented substantially horizontally and a pair of guiding and stretching surface regions, there being a guiding and stretching surface region for each support surface region with the guiding and stretching surface region of each support surface region extending from its associated support surface region in what is, in use, an upward direction;

a pair of elongate elements, that are receivable on the support surface regions to be supported thereby when the support members are spaced apart, with one element extending between one support surface region of one support member and one support surface region of the other support member and the other element extending between the other two support surface regions; and a flexible web that is securable to the elongate elements to extend therebetween.

The guiding and stretching surface regions of each support member slope towards one another. Conveniently, each guiding and stretching surface region may be at an angle of between 100° and 105° to its support surface region.

Each support member may also define a pair of locking surface regions, a locking surface region extending upwardly from each support surface region on the opposite side thereof to its guiding and stretching surface region.

In one form each support member may define a pair of "U"-shaped recesses, each recess having a base surface that constitutes a support surface region and two side surfaces, one of which constitutes a guiding and stretching surface region and the other a locking surface region.

Spaced restraining formations may be provided on each elongate element, that are engageable with those portions of the support member that define the support surface regions to restrain the support members against longitudinal movement relative to the elongate elements. Each elongate element may carry a pair of disc-like components that are spaced apart and are receivable on the support surface regions, these components having the restraining formations.Each component may have a channel, the sides thereof consituting the restraining formations for that component. Preferably, each component is circular and its channel extends around its cylindrical extremity, and each support member has an arcuate transition region, with a radius that is similar to that of the components, between each of its support surface regions and guiding and stretching surface regions.

The elongate elements may be rotatably secured to the web. The web may accordingly have loops or casings in which the elongate elements are received.

In one form, the support members may be of shaped lengths of tube and uprights.

BRIEF DESCRIPTION OF THE DRAWINGS

The invention is now described by way of an example with reference to the accompanying diagrammatic drawings.

In the drawings.

DETAILED DESCRIPTION OF THE DRAWINGS

Figure 1:
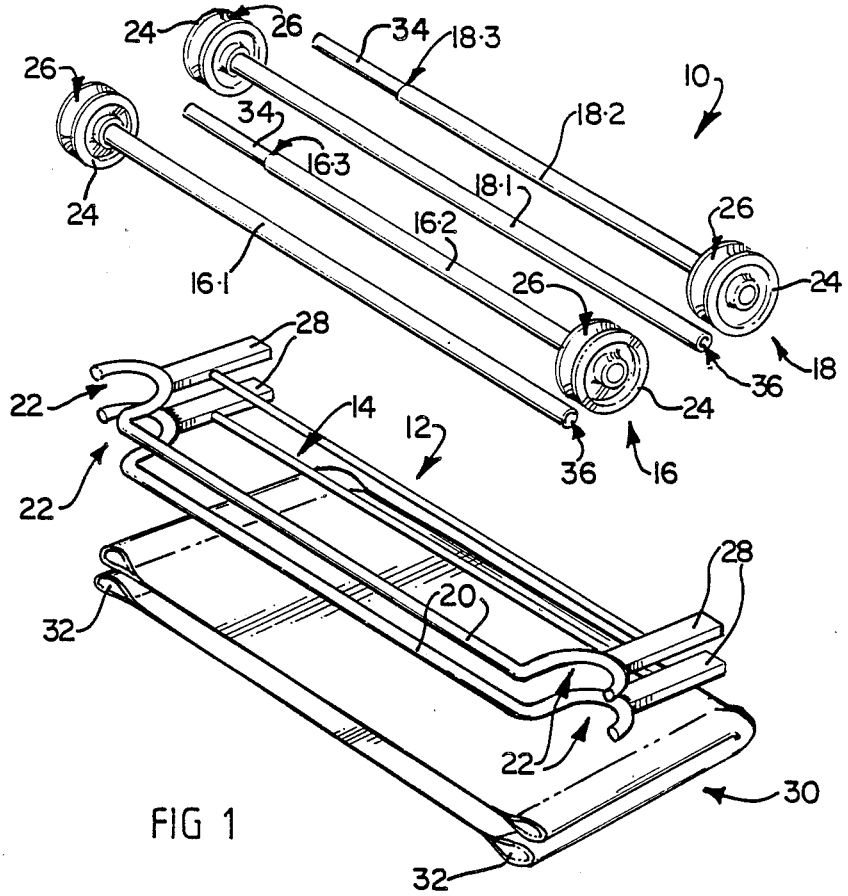
FIG. 1 shows a three-dimensional view of a collapsible bed in accordance with the invention in its collapsed configuration.

Referring to FIG. 1, a bed is designated generally by the reference numberal 10. The bed 10 comprises a pair of support members in the form of frames 12 and 14, and a pair of elongate elements in the form of collapsible bars 16 and 18 respectively.

Each frame 12, 14 is formed from tube 20. Each length of tube 20 is shaped to form a pair of spaced apart substantially U-shaped recesses 22 within which discs 24 of the bars 16,18 are removably receivable. Each disc 24 has a channel 26 formed in its periphery so that when the disc 24 is inserted into one of the recesses 22 of the frames 12,14, that portion of the frame 12,14 forming the recess 22 is snugly received within the channel 26 of the disc 24. The discs 24 are fast with the ends of the bars 16, 18.

The frames 12 and 14 each include legs 28 depending from those portions of the tubes 20 defining the recesses 22.

An elongate sheet of a flexible material, such as a canvas material, is provided to serve as a bed base 30. Casings 32 are defined in the longitudinal edges of the bed base 30 within which the bars 16 and 18 are rotatably receivable.

The bars 16 and 18 are each provided in two sections 16.1 and 16.2, and 18.1 and 18.2 respectively. The sections 16.2 and 18.2 have athinner region 16.3 and 18.3 respectively which define spigot-like formations 34 which are insertable into socket openings 36 in the free ends of the sections 16.1 and 18.1 respectively.

Figure 2:
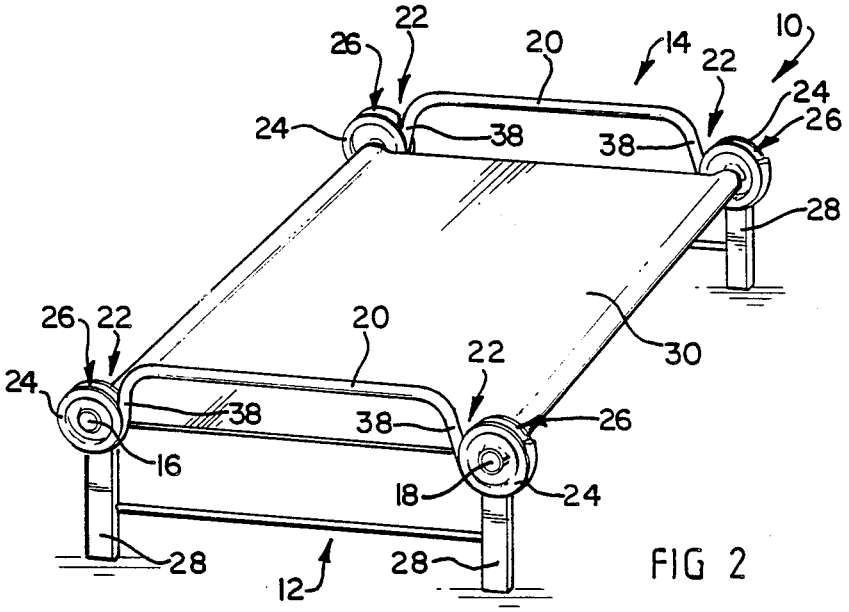
FIG. 2 shows a three-dimensional view of the bed of FIG. 1 in its erected configuration.

Referring now to FIG. 2, the bed 10 is shown in its erected configuration. To erect the bed 10, the sections 16.1 are inserted into the casings 32 of the bed base 30 from one end of the casings 32. The sections 16.2 and 18.2 are then inserted into the casings 32 from the other ends thereof so that the spigot formations 34 are received within the openings 36 of the sections 16.1 and 18.1. The bars 16 and 18 are rotatable in the casings 32. The frames 12 and 14 are then placed in a desired location with the recesses 22 of the frames 12 and 14 in alignment. The discs 24 of one of the bars are inserted into those recesses 22 of the frames 12 and 14 on one side which are aligned with each other. The discs 24 of the other bar are then inserted into the recesses 22 on the other side of the frames 12 and 14 so that the bed base 30 is stretched and made taut and spans the space between the bars 16 and 18.

To facilitate insertion of the discs 24 into the recesses 22 and stretching of the bed base 30, portions 38 of the tubular members 20 which form part of the U-shaped recesses 22 are angled at about 10° to 15° to the vertical and slope towards one another from the base of recesses 22 upwardly. Once the discs 24 are in the recesses 22, they are securely held therein.

It is an advantage of the invention that with an article of collapsible furniture in accordance with the invention, such furniture can be stowed easily and in a space-saving manner when not required for use. Also, the articles of furntiure can be relatively quickly erected by a single person when required for use and are extremely stable.

I claim:

1. A collapsible article of furniture, such as a bed comprising: two, spaced apart, rigid head and foot board support members, each said support member having a base portion and a cylindrical element connected to and extending along the upper part of the base portion, each said cylindrical element having a pair of substantially U-shaped receiving portions extending substantially vertically upwardly from said base portion and being positioned at opposite ends thereof; a pair of elongated elements, each having a pair of disc components mounted at opposite ends thereof; a flexible web spanning said elongated elements and extending therebetween; and each said elongated element extending between said head and foot support members so that when said disc components are inserted into the U-shaped receiving portions, said flexible web is stretched and made taut.

2. The article of furniture according to claim 1, wherein said head and foot support members are identically shaped and said elongated elements are identically shaped.

3. The article of furniture according to claim 1, wherein each said cylindrical element and said corresponding pair of substantially U-shaped receiving portions are made integral.

4. The article of furniture claimed in claim 1, wherein each said U-shaped receiving portion comprises a base surface constituting a support surface region and opposing side surfaces, one of which constituting a guiding and stretching surface region and the other a locking surface region.

5. The article of furniture as claimed in claim 1, wherein each said guiding and stretching surface region is at an angle of between 100 degrees and 105 degrees to said support surface region.

6. The article of furniture claimed in claim 1, in which the elongate elements are rotatably located in casings in the web.

7. The article of furniture claimed in claim 1, in which each base portion predetermined includes a shaped length of tubing and upright support elements secured thereto forming a pair of legs.

* * * * *